US005899612A

United States Patent [19]

Kobayashi et al.

[11] Patent Number: 5,899,612

[45] Date of Patent: May 4, 1999

[54] DOCUMENT FEEDER HAVING RETRACTABLE DOCUMENT GUIDING MEMBER

[75] Inventors: Hiroshi Kobayashi; Toru Tanjo; Hiroyuki Harada; Kazuhisa Kondo; Jun Kusakabe; Masahiro Sako, all of Osaka, Japan

[73] Assignee: Mita Industrial Co., Ltd., Osaka, Japan

[21] Appl. No.: 09/005,845

[22] Filed: Jan. 12, 1998

[30] Foreign Application Priority Data

Jan. 17, 1997 [JP] Japan ..... 9-007065

[51] Int. Cl.[6] ..... G03G 15/00

[52] U.S. Cl. ..... 399/367; 399/124; 399/365

[58] Field of Search ..... 399/365, 367, 399/373, 124; 271/264, 273

[56] References Cited

U.S. PATENT DOCUMENTS 5,363,184 11/1994 Matsuo et al. ..... 399/367

*Primary Examiner*—Matthew S. Smith

*Attorney, Agent, or Firm*—Smith, Gambrell & Russell; Beveridge, DeGrandi, Weilacher & Young Intellectual Property Group

[57] ABSTRACT

A document feeder having a cover covering a portion of a main body and adapted to be pivotally opened, and a pair of document transportation rollers provided in an abutting relation in the midst of a document transportation path for transportation of a document original. A document guiding member for guiding the document original to an abutment position of the pair of rollers is attached to the cover.

4 Claims, 9 Drawing Sheets

DOCUMENT FEEDER HAVING RETRACTABLE DOCUMENT GUIDING MEMBER

BACKGROUND OF THE INVENTION

1. Field of the Invention

The present invention relates to a document feeder to be applied to an image processing apparatus such as a copying machine, a facsimile machine or an image reader.

2. Description of Related Art

Automatic document feeders are conventionally known which are applied to copying machines and the like and adapted to separate document originals set on a document placing plate on a one-by-one basis and feed the separated document original to a copying position through a document transportation path. As shown in FIG. 11, a document feeder of this type typically employs a path 595 curved with a predetermined curvature radius as the document transportation path. In this case, a pair of registration rollers 596 for secondary document feeding are provided in an abutting relation at the vertex of the curved document transportation path 595. A document guiding member 598 such as of a sheet for smoothly guiding a document original to an abutment position 597 of the registration roller pair 596 along the curved document transportation path 595 is provided immediately upstream of the abutment position 597 of the registration roller pair 596.

When a cover 599 is opened for a jam recovery operation, the document guiding member 598 located immediately upstream of the abutment position 597 of the registration roller pair 596 hinders the jam recovery operation.

Therefore, the document guiding member 598 is movably provided in place. More specifically, the document guiding member 598 is attached to a distal edge of an arm member 601 attached to a main body pivotally about a pivotal axis 600. When the jam recovery operation is to be performed, the cover 599 is opened, and then the arm member 601 is pivoted so that the document guiding member 598 is retracted from the vicinity of the abutment position 597 of the registration roller pair 596.

However, this arrangement requires the special arm member 601 for retracting the document guiding member 598, thereby leading to a complicated construction. In addition, the retraction of the document guiding member 598 for the jam recovery operation requires a two-step procedure in which the cover 599 is first opened and then the arm member 601 is pivoted. This makes the jam recovery operation troublesome.

SUMMARY OF THE INVENTION

It is an object of the present invention to provide a document feeder which has a simplified construction for retracting a document guiding member and features an easier operation for retracting the document guiding member.

The document feeder according to the present invention comprises: a main body; a cover covering a portion of the main body and adapted to be pivotally opened; a pair of document transportation rollers provided in an abutting relation in the midst of a document transportation path for transportation of a document original; and a document guiding member for guiding the document original to an abutment position where the pair of rollers abut against each other, the document guiding member being attached to the cover and disposed adjacent to the abutment position of the pair of rollers when the cover is closed.

In accordance with the invention, the document guiding member is attached to the cover. Therefore, when the cover is opened for the jam recovery operation, for example, the document guiding member is retracted from the vicinity of the abutment position of the rollers. Therefore, the jam recovery operation can readily be performed in comparison with the prior art.

This obviates a special arrangement for the retraction of the document guiding member, thereby simplifying the overall construction of the document feeder.

In accordance with one embodiment of the invention, the document feeder further includes a support member for supporting the document guiding member movably with respect to the cover, a guided member attached to the support member, and a guiding member provided in the main body and having a guide surface for guiding on the guide surface the guided member moving in association with the opening and closing of the cover, and the guide surface has a configuration such as to prevent the document guiding member from interfering with the rollers when the cover is opened or closed.

With this arrangement, the guided member attached to the support member supporting the document guiding member is guided on the guide surface of the guiding member. Since the document guiding member is supported movably with respect to the cover by the support member, the guided member travels in conformity with the configuration of the guide surface. As described above, the guide surface has a configuration such as to prevent the document guiding member from interfering with the rollers when the cover is opened or closed. Therefore, the document guiding member never interferes with the rollers in the opening and closing of the cover. Thus, the document guiding member can be brought closer to the abutment position of the pair of rollers, so that the document can properly be guided by the document guiding member.

The guide surface preferably has an engagement portion to be engaged with the guided member when the cover is closed.

With this arrangement, the guided member is engaged with the engagement portion when the cover is closed after the jam recovery operation. Therefore, the positional relation between the document guiding member and the pair of rollers is not changed by the opening and closing of the cover. Thus, the accuracy of the document guiding operation can be kept substantially constant.

The foregoing and other objects, features and effects of the present invention will become more apparent from the following description of the preferred embodiment with reference to the attached drawings.

DESCRIPTION OF THE PREFERRED EMBODIMENTS

Figure 1:
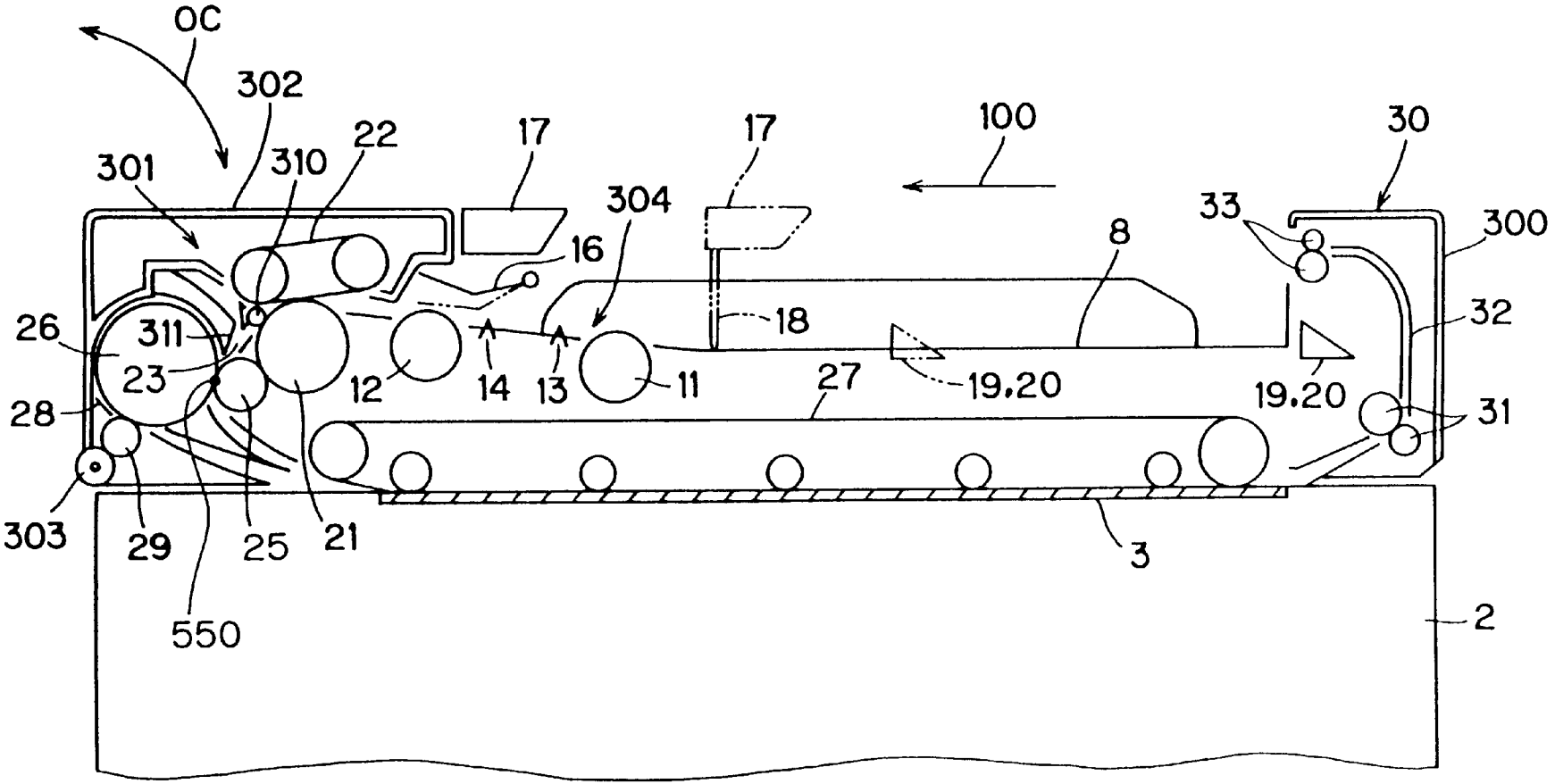
FIG. 1 is a sectional view schematically illustrating the internal construction of a recycle document feeder according to one embodiment of the present invention as viewed from the front side thereof.
Figure 2:
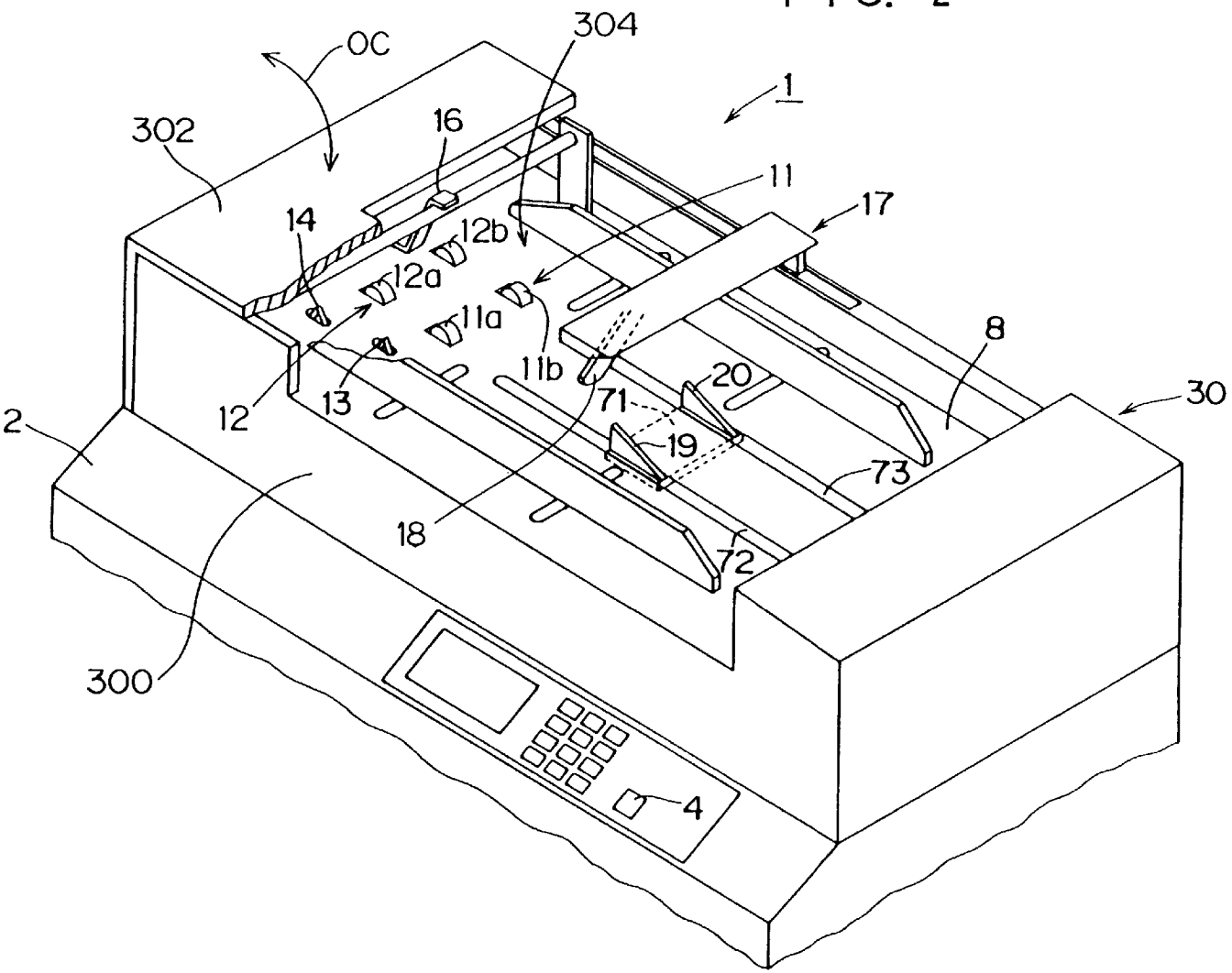
FIG. 2 is a partially cut-away perspective view of the recycle document feeder.

FIG. 1 is a sectional view schematically illustrating the internal construction of a recycle document feeder according to one embodiment of the present invention as viewed from the front side thereof. FIG. 2 is a partially cut-away perspective view of the recycle document feeder.

The recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3.

The recycle document feeder 1 includes a main body 300 and a feeder cover 302 covering a feeding mechanism 301. The feeder cover 302 is attached to the main body 300 in such a manner that the feeder cover 302 can cover the feeding mechanism 301 and be opened pivotally about a pivotal axis 303 along a lower edge of the main body 300 in an opening and closing direction OC. When a jam recovery operation is to be performed, the feeder cover 302 is opened to expose the feeding mechanism 301.

A document placing plate 8 for holding thereon document originals to be fed onto the contact glass 3 is provided in the center of the upper face of the main body 300. The document placing plate 8 includes a feed out mechanism 304 for guiding the document originals to a predetermined feed position and assisting in the feeding of the document originals set in the feed position.

The feed out mechanism 304 includes a forward feed roller 11 and a main feed roller 12. As shown in FIG. 2, the forward feed roller 11 includes two unit rollers 11*a* and 11*b* spaced a predetermined distance from each other perpendicularly to a document transportation direction. The main roller 12 includes two unit rollers 12*a* and 12*b* spaced a predetermined distance from each other perpendicularly to the document transportation direction.

A preset switch 13 for detecting document originals placed on the document placing plate 8 is provided downstream of the forward feed roller 11 with respect to the document transportation direction. When a user places a stack of document originals on the document placing plate 8, the preset switch 13 is turned on. In response thereto, the driving of the forward feed roller 11 and the main feed roller 12 is started. As a result, the stack of document originals placed on the document placing plate 8 is transported in the direction of an arrow 100 (leftward as seen in FIG. 1).

A set switch 14 is provided downstream of the preset switch 13 with respect to the document transportation direction. The driving of the forward feed roller 11 and the main feed roller 12 is stopped after a lapse of a predetermined time period from a time point at which the set switch 14 is turned on by the transported document stack. Thus, the stack of document originals is set in the feed position.

When a print key 4 provided on the front upper portion of the copying machine body 2 is pressed with the document originals thus set in place, a partitioning unit 17 previously located in its home position (as indicated by a solid line in FIG. 1) above the forward feed roller 11 and the main feed roller 12 is moved in a direction opposite to the document transportation direction by a distance, which depends on the size of the document originals set in place, so as to be located in a position as indicated by a two-dot-and-dash line in FIG. 1.

The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of the document originals fed back onto the document placing plate 8 through a document discharge portion 30 are aligned and the document originals subjected to the document feeding operation are divided from the document originals yet to be subjected to the document feeding operation.

In response to the pressing of the print key 4, two action plates 19 and 20 previously located in their home positions within the document discharge portion 30 (as indicated by a solid line in FIG. 1) are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8, and adapted to be moved in unison along guide rails 72 and 73 spaced apart from each other perpendicularly to the document transportation direction on the document placing plate 8.

The action plates 19 and 20 are each comprised of a generally right-angled triangular planar plate having an edge inclined upward toward the document transportation direction as viewed horizontally and perpendicularly to the direction of their movement. Therefore, a document original first fed back onto the document placing plate 8 is guided by the inclined edges of the action plates 19 and 20 so that the leading edge of the document original is prevented from bumping against the trailing edges of the document originals set in the feed position and rested thereon.

Further, in response to the pressing of the print key 4, a pressing member 16 provided above the main feed roller 12 is shifted from an upper position as indicated by a solid line in FIG. 1 to a lower position as indicated by a two-dot-and-dash line thereby to press the leading edge of the document stack set in the feed position against the main feed roller 12. Thus, a sufficient transportation force is applied to the document originals to be fed into the document transportation path 23.

The feeding mechanism 301 is provided downstream of the main feed roller 12 with respect to the document transportation direction. The feeding mechanism 301 includes a separator roller 21 for separating and feeding the document originals one by one from the feed position into the document transportation path 23, and a separator belt 22 opposed to the separator roller 21. The document transportation path 23 is curved with a predetermined curvature radius, and adapted to reverse a document original and feed the reversed document original to a copying position on the contact glass 3.

The feeding mechanism 301 includes a transportation assist roller 310 for applying a transportation assist force to the document original fed into the document transportation path 23, and a document guiding member 311 for guiding the document original to an abutment position 550 where a registration roller 25 abuts against a registration/reverse roller 26. The transportation assist roller 310 is provided in the vicinity of an entrance port of the document transportation path 23 and abuts against the separator roller 21. The document guiding member 311 defines a part of a wall of the document transportation path 23 and extends to a position immediately upstream of the abutment position 550 between the registration roller 25 and the registration/reverse roller 26.

When the print key 4 is pressed, the movement of the partitioning unit 17 and the action plates 19 and 20, the positional shift of the pressing member 16 and the driving of the forward feed roller 11 and the main feed roller 12 are started. As a result, the lowermost one of the document originals (in the document stack) is separated from the other document originals and fed into the document transportation path 23 by cooperation of the separator roller 21 and the separator belt 22.

The document original fed into the document transportation path 23 is guided to an abutment position where the separator roller 21 abuts against the transportation assist roller 310. As a result, a transportation assist force is applied to the document original fed into the document transportation path 23. Thus, even if the document original is thick and stiff, the document original can be guided to the abutment position between the registration roller 25 and the registration/reverse roller 26 without bumping against the interior wall surface of the document transportation path 23. The document guiding member 311 guides the document original to the abutment position between the registration roller 25 and the registration/reverse roller 26.

The document original guided to the abutment position 550 between the registration roller 25 and the registration/reverse roller 26 is further transported by the rollers 25 and 26 driven in a predetermined timing, and then placed in the copying position on the contact glass 3 of the copying machine body 2 by the transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, by the registration/reverse roller 26 and a reverse roller 29 and by the registration roller 25 and the registration/reverse roller 26, and placed on the contact glass 3 again by the transportation belt 27. Then, the document original is subjected to the image reading operation by the copying machine so that the image on the back side of the document original is first read. Thereafter, the document original is reversed again, and the image on the front side of the document original is read.

The document original subjected to the image reading operation is transported to the document discharge portion 30 by the transportation belt 27. The document original transported to the document discharge portion 30 is further transported through a discharging path 32 by a discharge roller pair 31, and then discharged onto the document placing plate 8 by a discharge roller pair 33. Thus, the document original subjected to the image reading operation is fed back onto the document placing plate 8.

Figure 3:
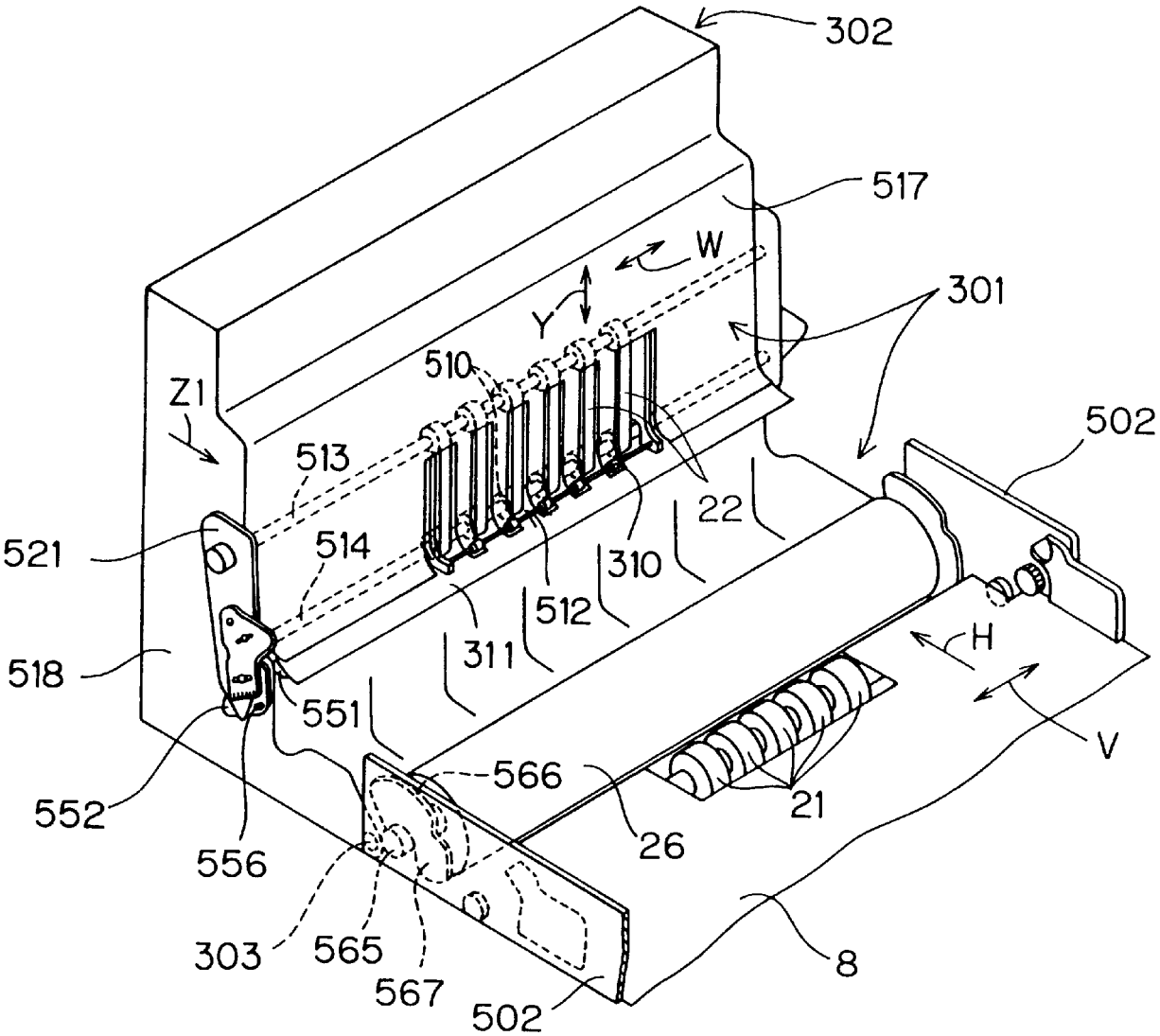
FIG. 3 is a perspective view illustrating a portion of the recycle document feeder with a feeder cover being opened.

FIG. 3 is a perspective view illustrating a portion of the recycle document feeder with the feeder cover 302 being opened. As described above, the feeder cover 302 is attached to the main body 300 in such a manner that the feeder cover 302 can be opened pivotally about the pivotal axis 303 to expose the feeding mechanism 301 to the outside for the jam recovery operation. The components of the feeding mechanism 301 are dividedly provided in the main body 300 and in the feeder cover 302. More specifically, the separator roller 21 and the registration/reverse roller 26 are provided in the main body 300. The separator belt 22, the transportation assist roller 310 and the document guiding member 311 are provided in the feeder cover 302.

As described above, the document guiding member 311 is provided in the feeder cover 302. Therefore, when the feeder cover 302 is opened for the jam recovery operation and the like, the document guiding member 311 is retracted from the vicinity of the abutment position 550 (see FIG. 1) between the registration roller 25 and the registration/reverse roller 26 along with the feeder cover 302, so that the jam recovery operation can readily be performed.

Figure 4:
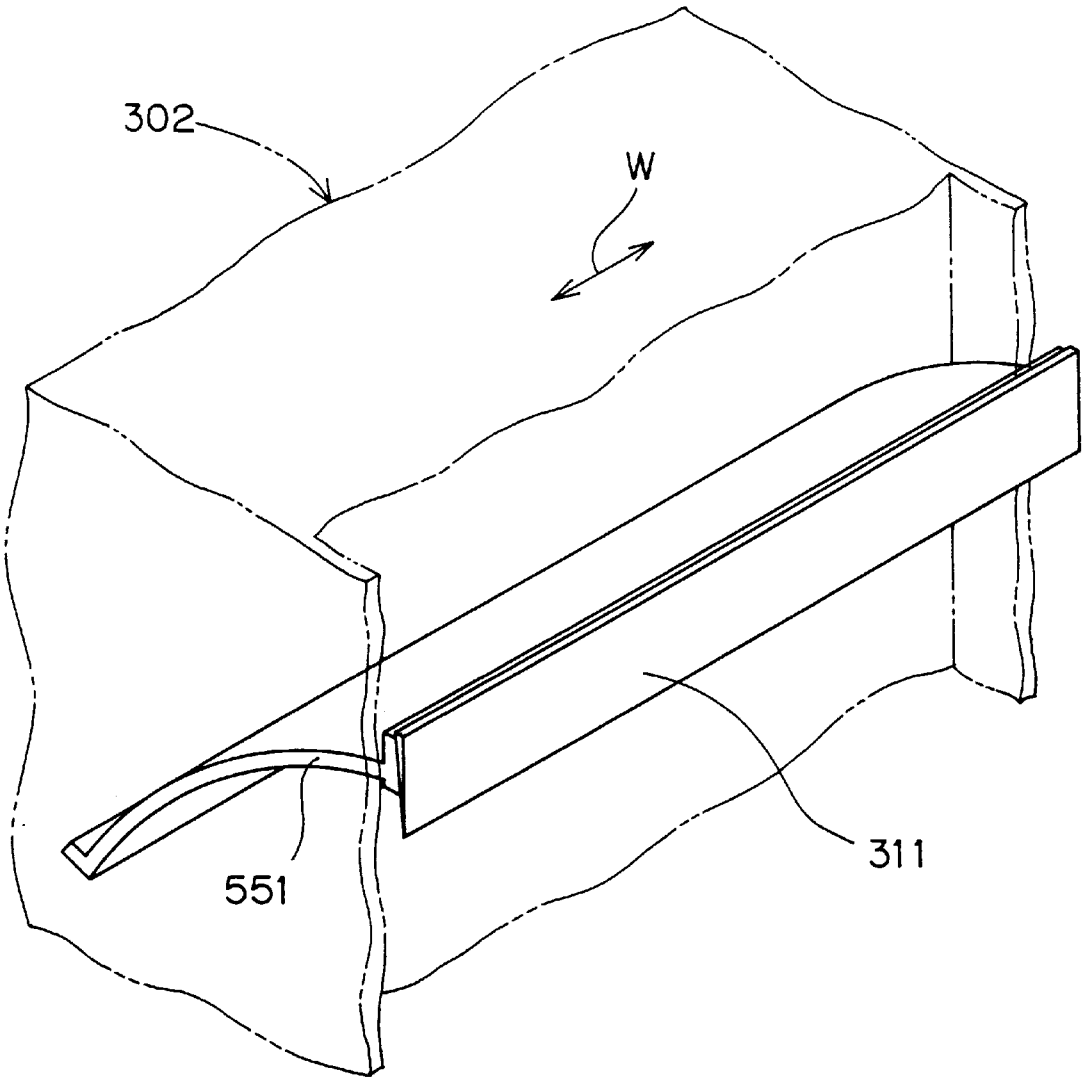
FIG. 4 is a perspective view illustrating a document guiding member attached to the feeder cover.
Figure 5:
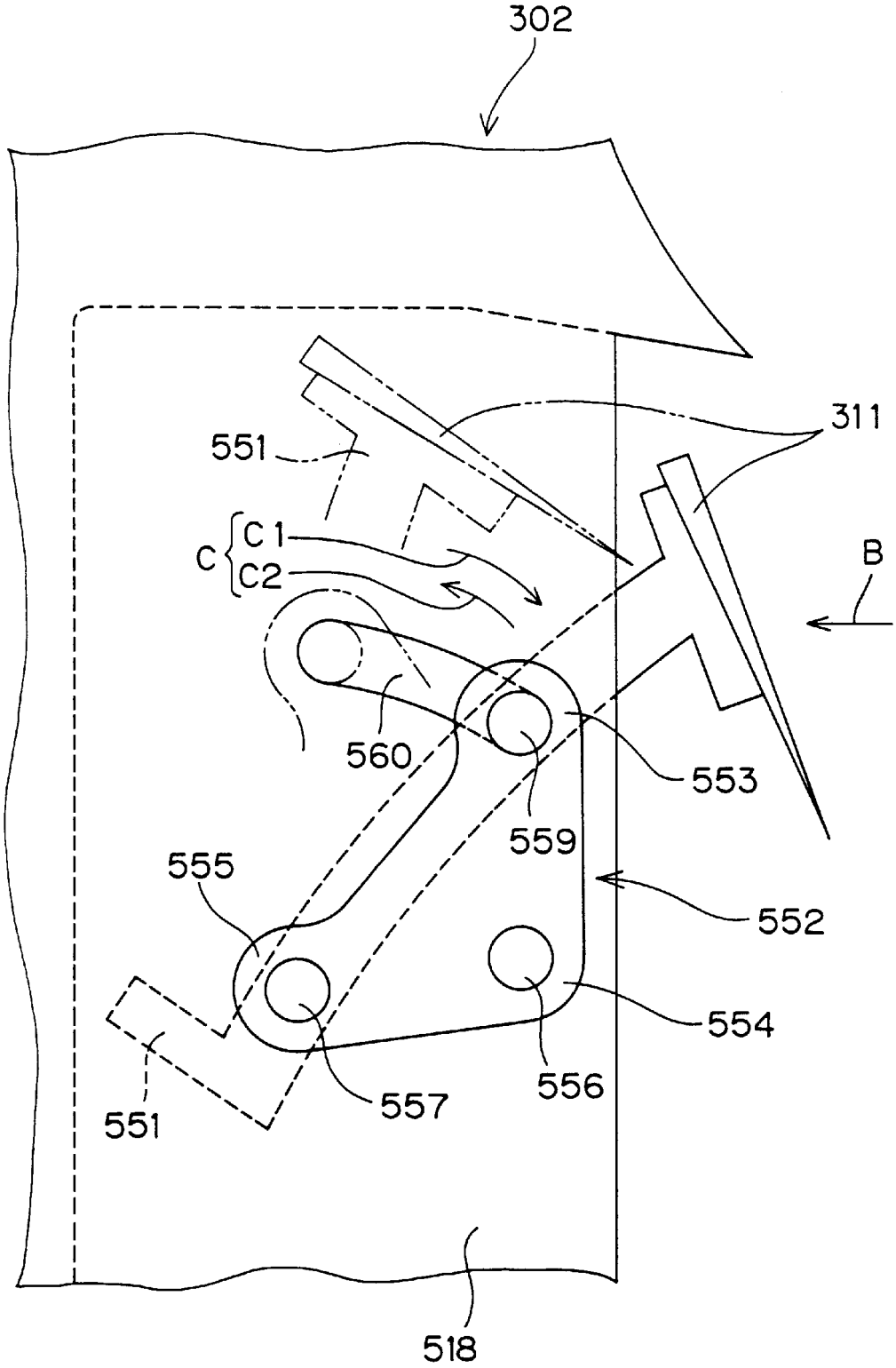
FIG. 5 is a front view illustrating an arrangement where the document guiding member is attached to the feeder cover.
Figure 6:
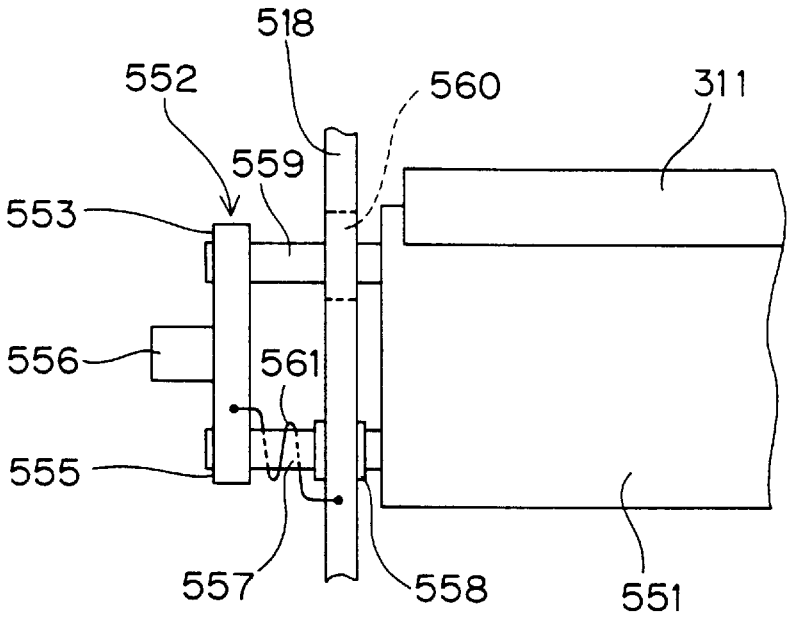
FIG. 6 is a right side view illustrating the arrangement of FIG. 5 as seen the direction of an arrow B in FIG. 5.

An arrangement related to the document guiding member 311 in the feeding mechanism 301 will hereinafter be described with reference to FIGS. 3 through 6. FIG. 4 is a perspective view illustrating the document guiding member 311 attached to the feeder cover 302. FIG. 5 is a front view (as seen from the front side of the copying machine) illustrating an arrangement where the document guiding member 311 is attached to the feeder cover 302. FIG. 6 is a right side view illustrating the arrangement of FIG. 5 as seen in the direction of an arrow B in FIG. 5.

Referring to FIG. 3, the separator belt 22 is provided in a generally middle portion of the feeder cover 302. The separator belt 22 includes a plurality of unit separator belts (six unit separator belts in FIG. 3) provided in a predetermined spaced relation along the width of the feeder cover 302 (i.e., in a cover width direction W). The unit separator belts are endless belts which are each stretched around a pair of pulleys 510 spaced a predetermined distance from each other perpendicularly to the cover width direction W (i.e., in a cover length direction Y). Portions of the respective unit separator belts are exposed out of a plurality of elongate belt exposure openings 512 (six belt exposure openings in FIG. 3) formed in an interior wall 517 of the feeder cover 302 along the cover length direction Y.

One of the pulleys 510 closer to the distal edge of the feeder cover 302 is fitted around a first belt shaft 513 extending in the cover width direction W, while the other pulley 510 closer to the pivotal axis 303 of the feeder cover 302 is fitted around a second belt shaft 514 extending in the cover width direction W.

The opposite ends of the first belt shaft 513 are respectively coupled to the corresponding ends of the second belt shaft 514 by elongate planar coupling arms 521 each extending in the cover length direction Y with a distance between the shafts defined by the coupling arms 521.

The interior wall 517 of the feeder cover 302 has a gradually inclined surface formed adjacent to the second belt shaft 514, and projecting in a direction Z1 more apart from the interior wall 517 of the feeder cover 302 as the distance to the pivotal axis 303 decreases. The document guiding member 311 is located adjacent to an edge of the inclined surface closer to the pivot axis 303 of the feeder cover 302. That is, the document guiding member 311 is provided adjacent to the second belt shaft 514 of the separator belt 22.

The document guiding member 311 is an elongate sheet, such as of a PET film, extending in the cover width direction W. The document guiding member 311 is supported by a support member 551 having an elongate face extending in the cover width direction W and a portion extending inwardly of the feeder cover 302 as shown in FIG. 4.

As shown in FIGS. 5 and 6, the support member 551 is attached to the feeder cover 302 with the opposite ends thereof being fixed to the coupling plates 552 provided on the exterior faces of side walls 518 of the feeder cover 302. As shown in FIG. 5, the coupling plates 552 are generally triangular plates each having a distal tip portion 553, a pin provision portion 554 located closer to the pivotal axis of the feeder cover 302 than the distal tip portion 553 and having a cylindrical guide pin 556 provided thereon as the guided member, and a support portion 555 located on a side of the pin provision portion 554 opposite from the interior wall 517 of the feeder cover 302, and disposed with a linear edge between the distal tip portion 553 and the support portion 555 extending along the support member 551.

A support shaft 557 is attached to a portion of the support member 551 distant from the document guiding member 311. The support shaft 557 is rotatively supported by bearings 558 provided in the side walls 518 of the feeder cover 302 and the opposite ends thereof are respectively fixed to the support portions 555 of the coupling plates 552. A pivotal shaft 559 is fixed to a portion of the support member 551 closer to the document guiding member 311 and extends through pivot holes 560 formed in the side walls 518. The opposite ends of the pivotal shaft 559 are respectively fixed to the distal tip portions 553 of the coupling plates 552. The pivot holes 560 are elongate holes each extending along a pivot direction C. The feeder cover 302 has a sufficient inside space to accommodate the support member 551 and the document guiding member 311 and to evade the registration/reverse roller 26. This arrangement permits the support member 551 to be pivoted about the support shaft 557 in the pivot direction C as shown in FIG. 5.

As shown in FIG. 6, a torsion spring 561 is fitted around the support shaft 557 with its opposite ends respectively fixed to the coupling plate 552 and the exterior face of the side wall 518 of the feeder cover 302. The torsion spring 561 biases the coupling plate 552 in a first pivot direction C1 such that the coupling plate 552 is shifted from a position indicated by a two-dot-and-dash line to a position indicated by a solid line in FIG. 5. Therefore, the coupling plate 552 is located in the position indicated by the solid line, unless a force is applied to the coupling plate 552 to shift the coupling plate 552 from the position indicated by the solid line to the position indicated by the two-dot-and-dash line in a second pivot direction C2. At this time, the document guiding member 311 is located in a position as indicated by a solid line in FIG. 5.

In FIG. 3, the registration/reverse roller 26 is located downstream of the separator roller 21 with respect to the document transportation direction H in the main body 300. The registration/reverse roller 26 extends horizontally and perpendicularly to the document transportation direction H (in a document width direction V). The registration/reverse roller 26 is fitted around a roller shaft 565 extending in the document width direction V.

Figure 7:
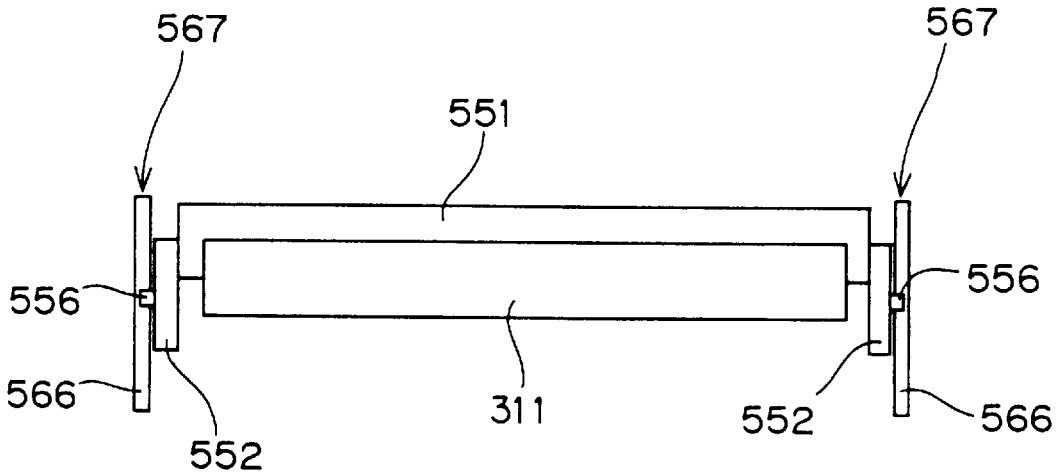
FIG. 7 is a diagram illustrating a state of the document guiding member in the midst of the opening or closing of the feeder cover as seen from the upper side thereof.

Disposed adjacent to each end of the registration/reverse roller 26 is a pin guiding plate 567 as the guiding member having a guide surface 566 for guiding the guide pin 556 of the coupling plate 552 in the feeder cover 302 when the feeder cover 302 is opened or closed. More specifically, the guide pin 556 is guided on the guide surface 566 in the opening and closing of the feeder cover 302 as shown in FIG. 7, which illustrates the document guiding member as viewed from the upper side thereof.

Figure 8:
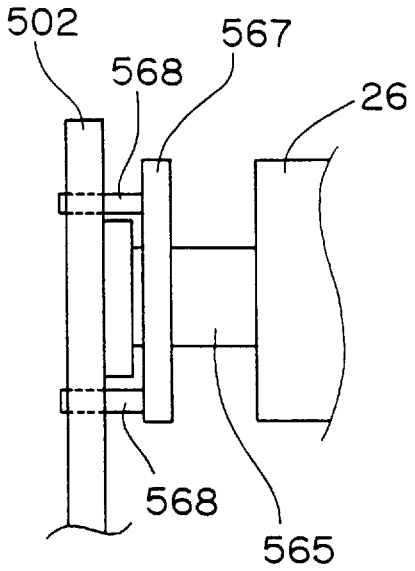
FIG. 8 is a top plan view illustrating an arrangement around an end of a registration/reverse roller.
Figure 9:
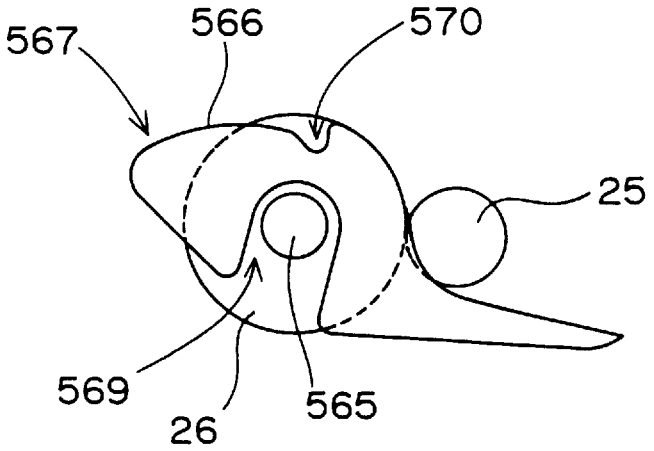
FIG. 9 is a side view of a pin guiding plate.

As shown in a top plan view of FIG. 8 which illustrates an arrangement around one end of the registration/reverse roller 26, the pin guiding plate 567 is fixed to a side plate 502 of the main body 300 by a fixing pin 568. As shown in FIG. 9 which is a side view of the pin guiding plate 567, the pin guiding plate 567 has a recess 569 formed in its lower position and having a shape which evades the roller shaft 565 and prevents the pin guiding plate 567 from rotating with the rotation of the registration/reverse roller 26. The upper face of the pin guiding plate 567, which serves as the guide surface 566, has a configuration such as to conform to the circumference of the registration/reverse roller 26. A positioning recess 570 is formed in a middle portion of the guide surface 566, and serves as the engagement portion for receiving the guide pin 556 with the feeder cover 302 being closed.

Figure 10A:
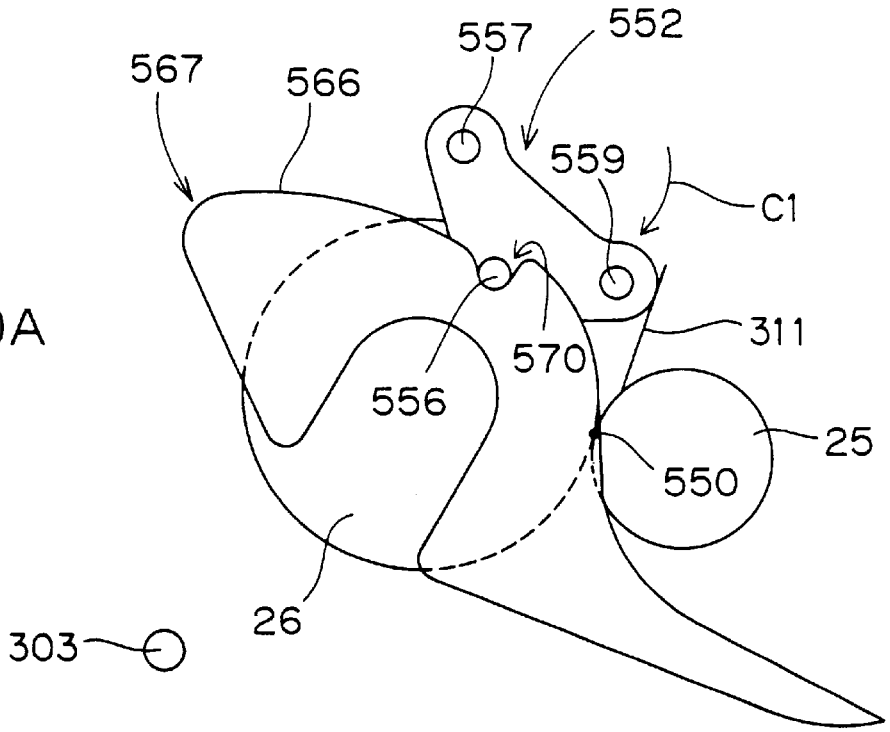
FIGS. 10A and 10B are diagrams for explaining the movement of the document guiding member when the feeder cover is opened.
Figure 10B:
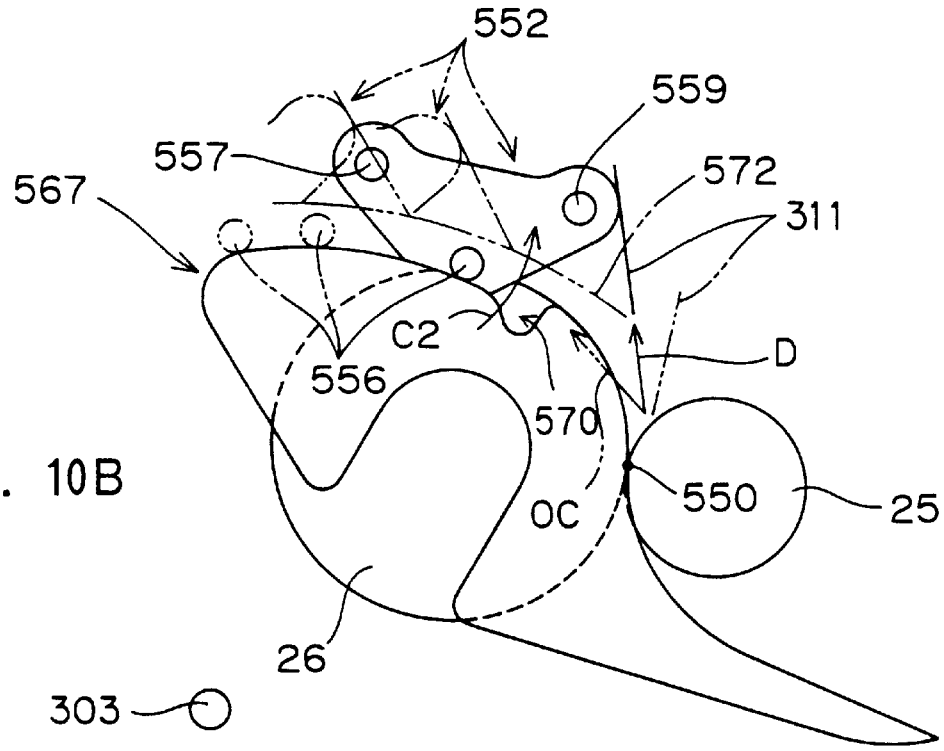
Figure 11:
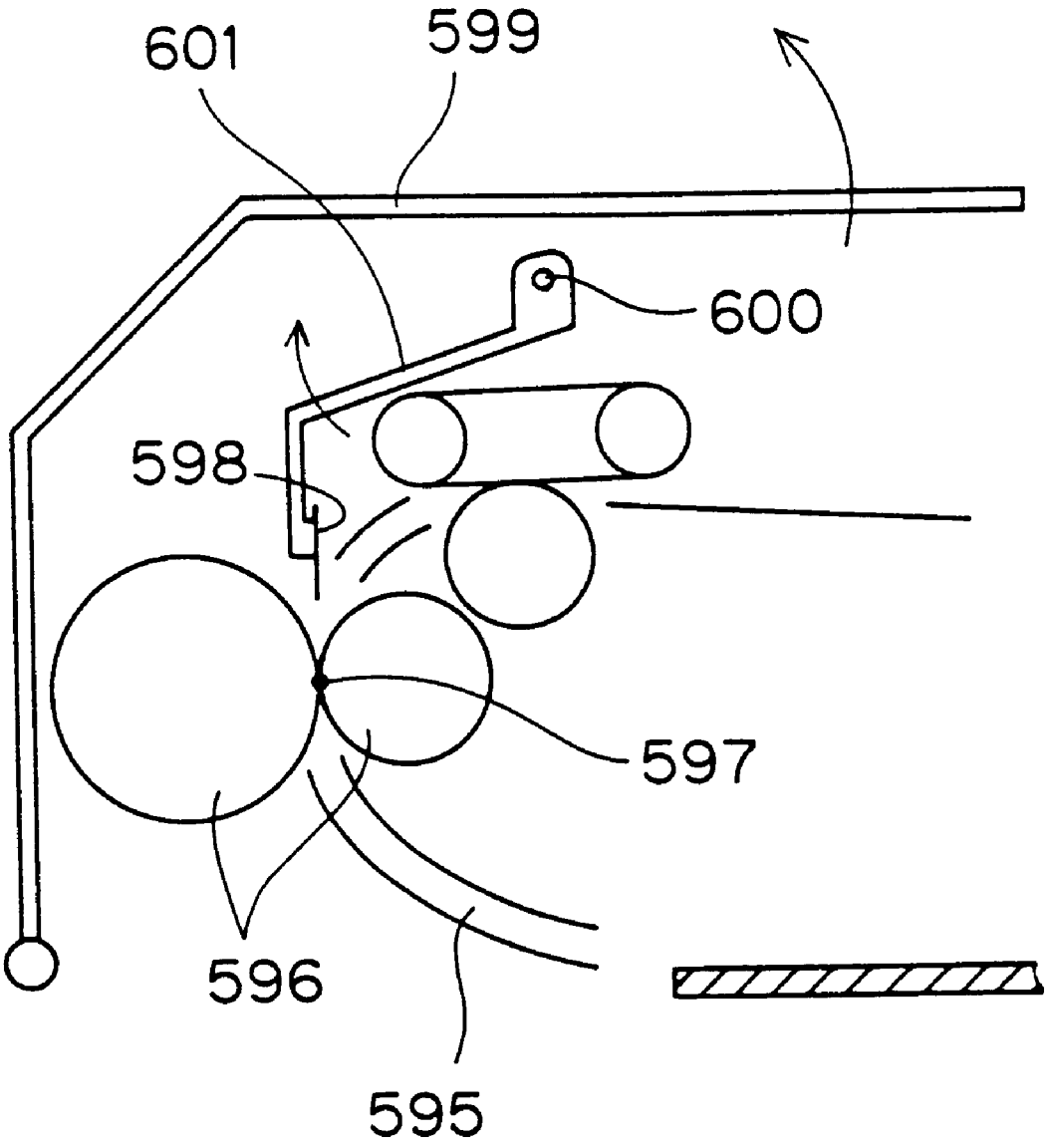
FIG. 11 is a diagram illustrating the construction of a prior art feeding mechanism.

FIGS. 10A and 10B are diagrams for explaining the movement of the document guiding member 311 when the feeder cover is opened. With the feeder cover 302 being closed (see FIG. 10A), the guide pin 556 is fitted in the positioning recess 570 formed in the guide surface 566 of the pin guiding plate 567. At this time, the coupling plate 552 is biased in the first pivot direction C1 (see FIG. 5) by a biasing force of the torsion spring 561 (see FIG. 6), so that the coupling plate 552 is pressed against the guide surface 566 from its upper side. In this state, the distal edge of the document guiding member 311 extends to the position immediately upstream of the abutment position 550 between the registration roller 25 and the registration/reverse roller 26. Thus, the transported document original is assuredly guided to the abutment position 550 between the registration roller 25 and the registration/reverse roller 26 by the document guiding member 311.

If a document original is jammed during the transportation thereof, the feeder cover 302 is opened for the jam recovery operation. When the feeder cover 302 is opened, the guide pin 556 is guided on an interior surface of the positioning recess 570 and raised onto the guide surface 566. That is, the guide pin 556 is guided in a direction such as to be opposed to the biasing force of the torsion spring 561. At this time, a force is applied to the coupling plate 552 in the second pivot direction C2 which is opposite to the direction of the biasing force of the torsion spring 561. As a result, the pivot shaft 559 is pivoted about the support shaft 557 in the second pivot direction C2, so that the coupling plate 552 assumes a state as indicated by a solid line in FIG. 10B. At this time, the document guiding member 311 is pivoted with the pivoting of the coupling plate 552. That is, the document guiding member 311 moves not in the direction OC of the opening and closing of the feeder cover 302 but in the direction D apart from the registration/reverse roller 26.

As the feeder cover 302 is opened, the guide pin 556 travels on the guide surface 566 as indicated in succession by two-dot-and-dash lines in FIG. 10B while being pressed against the guide surface 566 by the biasing force of the torsion spring 561. When the guide pin 556 is guided from the positioning recess 570 onto the guide surface 566, the distal edge of the document guiding member 311 is guided upwardly apart from the registration/reverse roller 26. Therefore, as the guide pin 556 travels on the guide surface 566, the distal edge of the document guiding member 311 travels on the guide surface 566 along a track 572 which conforms to the geometry of the guide surface 566. That is, the distal edge of the document guiding member 311 travels so as to evade from the registration/reverse roller 26.

When the feeder cover 302 is closed, the document guiding member 311 is guided in the reverse order to that described above. Accordingly, the document guiding member 311 is guided without interfering with the registration/reverse roller 26 when the feeder cover is closed. Finally, the document guiding member 311 is located immediately upstream of the abutment position 550 between the registration roller 25 and the registration/reverse roller 26 with the guide pin 556 being fitted in the positioning recess 570.

In accordance with this embodiment, the document guiding member 311 can be moved while evading from the registration/reverse roller 26 in the opening and closing of the feeder cover 302. Thus, the document guiding member 311 can be located immediately upstream of the abutment position 550 between the registration roller 25 and the registration/reverse roller 26, so that the document original can assuredly be guided to the abutment position 550 between the registration roller 25 and the registration/reverse roller 26. This prevents a document transportation delay, a document jam and like document feeding failures.

Since the guide pin 556 is fitted in the positioning recess 570 with the feeder cover 302 being closed, the document guiding member 311 can assuredly be positioned in place even after the document guiding member 311 is once retracted from the abutment position 550 in association with the opening of the feeder cover 302.

While one embodiment of the present invention has thus been described, the invention is not limited to this embodiment. The embodiment described above is directed to a case where the present invention is applied to a recycle document feeder to be mounted on a copying machine. Otherwise, the invention can be applied to a recycle document feeder for a facsimile machine or for an image reading apparatus connected to a computer or the like. Further, the invention can be applied not only to the recycle document feeder but also to an automatic document feeder which is adapted to discharge document originals to a special tray after the image reading operation.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application claims priority benefits of Japanese Patent Application No. 9-7065 filed on Jan. 17, 1997 under 35 USC 119, the disclosure thereof being incorporated herein by reference.

What is claimed is:

1. A document feeder, comprising:

a main body;

a cover covering a portion of the main body and adapted to be pivotally opened;

a pair of document transportation rollers provided in an abutting relation in a midst of a document transportation path for transportation of a document original;

a document guiding member for guiding a document original to an abutment position where the pair of rollers abut against each other, the document guiding member being attached to the cover and disposed adjacent to the abutment position of the pair of rollers with the cover being closed;

a support member for supporting the document guiding member movably with respect to the cover;

a guided member attached to the support member; and a guiding member provided in the main body and having a guide surface for guiding on the guide surface the guided member moving in association with the opening and closing of the cover, the guide surface having a configuration such as to prevent the document guiding member from interfering with the rollers when the cover is opened or closed, wherein the guide surface has an engagement portion to be engaged with the guided member when the cover is closed.

2. A document feeder as set forth in claim 1, wherein the pair of rollers are a registration roller pair for feeding a document original transported into the document transportation path to a setting position in a predetermined timing.

3. A document feeder as set forth in claim 1, further comprising:

a separator roller for separating and feeding document originals one by one into the document transportation path, wherein the document guiding member is located between the separator roller and the pair of rollers with the cover being closed.

4. A document feeder as set forth in claim 1, wherein the document transportation path is curved with a curvature radius, and wherein the pair of rollers are disposed in such a position that the abutment position thereof is located adjacent to a vertex of the curved document transportation path.

* * * * *